US006339992B1

(12) United States Patent
Watson

(10) Patent No.: US 6,339,992 B1
(45) Date of Patent: Jan. 22, 2002

(54) SMALL CHARGE BLASTING APPARATUS INCLUDING DEVICE FOR SEALING PRESSURIZED FLUIDS IN HOLES

(75) Inventor: John D. Watson, Evergreen, CO (US)

(73) Assignee: RockTek Limited, Pinjarra (AU)

( * ) Notice: Subject to any disclaimer, the term of this patent is extended or adjusted under 35 U.S.C. 154(b) by 0 days.

(21) Appl. No.: 09/289,683

(22) Filed: Apr. 9, 1999

Related U.S. Application Data

(60) Provisional application No. 60/124,274, filed on Mar. 11, 1999.

(51) Int. Cl.[7] ..... F42B 3/00

(52) U.S. Cl. ..... 102/312; 102/302; 102/313; 89/14.3; 42/79

(58) Field of Search ..... 102/312, 313, 102/302; 89/14.3; 42/79

(56) References Cited

U.S. PATENT DOCUMENTS

| | | | |
|---|---|---|---|
| 800,883 A | 10/1905 | Davidson | 68/1 |
| 993,907 A | 5/1911 | Swingle | |

(List continued on next page.)

FOREIGN PATENT DOCUMENTS

| | | |
|---|---|---|
| AU | 8546/22 | 8/1922 |
| AU | 34081/68 | 7/1972 |
| AU | 71 742/74 | 7/1974 |
| AU | 8539461 | 3/1985 |
| AU | 73614/87 | 5/1987 |
| AU | 33867/93 | 2/1993 |
| AU | 41210/93 | 11/1993 |
| AU | B-30436/92 | 1/1995 |
| AU | 73576/96 | 3/1997 |
| CH | 111089 | 7/1925 |
| EP | 108 519 | 11/1983 |
| EP | 311 025 | 5/1988 |
| GB | 320765 | 10/1929 |
| GB | 942750 | 11/1963 |
| WO | WO 91/02212 | 2/1991 |
| WO | WO 92/02709 | 2/1992 |
| WO | WO 95/28551 | 10/1995 |
| WO | WO 97/06402 | 2/1997 |
| WO | WO/97/10414 | 3/1997 |
| WO | WO 97/17588 | 5/1997 |
| WO | WO 98/20295 | 5/1998 |
| WO | WO 98/44309 | 10/1998 |
| WO | WO 99/31457 | 6/1999 |
| WO | WO 99/61864 | 12/1999 |
| ZA | 913432 | 7/1991 |
| ZA | 952646 | 3/1995 |
| ZA | 970578 | 1/1997 |

OTHER PUBLICATIONS

Young et al.: "Full–Scale Testing of the PCF Rock Excavation Method"; VIII Australian Tunnelling Conference; Sydney, Aug. 24–26, 1993.

Young, Chapman; Dick, Richard D.; Fourney, William L., "Small Charge Cone–Fracture Technique for Rapid Excavation", *Fragblast '90*, Aug. 26–31, 1990, Brisbane.

Young, Chapman; Barker, Donald, "Controlled Fracture Techniques for Continuous Drill and Blast", *National Science Foundation Grant No. CEE–8360551 Final Report on Phase 1*, Jul. 31, 1984, U.S. Dept. of Commerce.

(List continued on next page.)

*Primary Examiner*—Peter A. Nelson
(74) *Attorney, Agent, or Firm*—Sheridan Ross P.C.

(57) ABSTRACT

The present invention is directed to a small charge blasting system that provides a relief volume for a pressurized working fluid in the bore of a barrel that is inserted into a hole in the material to be broken, an end cap on the barrel to inhibit the entry of water and detritus into the bore, a stepped downhole end of the barrel to pressurize both the sidewall and bottom of the hole, and/or a thin barrel wall that flexes outwardly in response to pressure exerted on the wall by the pressurized working fluid to provide improved sealing of the fluid in the bottom of the hole.

29 Claims, 14 Drawing Sheets

U.S. PATENT DOCUMENTS

| | | | | | |
|---|---|---|---|---|---|
| 2,007,568 | A | | 7/1935 | Heitzman | 102/11 |
| 2,281,103 | A | | 4/1942 | MacDonald | 102/4 |
| 2,296,504 | A | | 9/1942 | Crater | 102/30 |
| 2,300,813 | A | | 11/1942 | Savage | 102/22 |
| 2,403,386 | A | | 7/1946 | Lubelsky et al. | 102/30 |
| 2,646,845 | A | | 7/1953 | Schillinger | 166/13 |
| 2,656,637 | A | * | 10/1953 | Richards | 42/79 |
| 2,725,821 | A | | 12/1955 | Coleman | 102/22 |
| 2,799,488 | A | | 7/1957 | Mandt | 262/9 |
| 2,876,700 | A | | 3/1959 | Householder | 102/30 |
| 2,995,087 | A | | 8/1961 | Edney et al. | 102/30 |
| 3,055,648 | A | | 9/1962 | Lawrence et al. | 262/12 |
| 3,151,556 | A | | 10/1964 | Karpovich | 102/24 |
| 3,173,368 | A | | 3/1965 | Griffith et al. | 102/30 |
| 3,188,906 | A | | 6/1965 | Beck | 86/20 |
| 3,208,348 | A | * | 9/1965 | Lee | 89/14 |
| 3,208,381 | A | | 9/1965 | Kihlström et al. | 102/30 |
| 3,264,992 | A | | 8/1966 | Beck | 102/30 |
| 3,307,445 | A | | 3/1967 | Stadler et al. | 86/20 |
| 3,313,234 | A | | 4/1967 | Mohaupt | 102/20 |
| 3,366,056 | A | | 1/1968 | Thunell et al. | 102/30 |
| 3,604,355 | A | | 9/1971 | Greenlees | 102/39 |
| 3,608,491 | A | | 9/1971 | Botes | 102/30 |
| 3,945,319 | A | | 3/1976 | Meagher | 102/22 |
| 3,954,058 | A | | 5/1976 | Sanders et al. | 102/30 |
| 3,960,082 | A | | 6/1976 | Sloevsky et al. | 102/22 |
| 4,004,684 | A | | 1/1977 | Scollins | 206/3 |
| 4,007,783 | A | | 2/1977 | Amancharia et al. | 166/135 |
| 4,040,355 | A | | 8/1977 | Hopler, Jr. | 102/22 |
| 4,074,629 | A | | 2/1978 | Colgate | 102/23 |
| 4,123,108 | A | | 10/1978 | Lavon | 299/16 |
| 4,140,188 | A | | 2/1979 | Vann | 175/4.51 |
| 4,141,592 | A | | 2/1979 | Lavon | 299/16 |
| 4,195,885 | A | | 4/1980 | Lavon | 299/1 |
| 4,204,715 | A | | 5/1980 | Lavon | 299/16 |
| 4,208,966 | A | | 6/1980 | Hart | 102/20 |
| 4,266,827 | A | | 5/1981 | Cheney | 200/20 |
| 4,315,463 | A | | 2/1982 | Arcand | 102/303 |
| 4,419,935 | A | | 12/1983 | Shibukawa | 102/313 |
| 4,436,017 | A | * | 3/1984 | Mohlin | 89/14 |
| 4,437,929 | A | | 3/1984 | Wong | 156/666 |
| 4,449,754 | A | | 5/1984 | Orlov et al. | 299/21 |
| 4,470,352 | A | | 9/1984 | Mashimo et al. | 102/313 |
| 4,508,035 | A | | 4/1985 | Leperre | 102/333 |
| 4,530,396 | A | | 7/1985 | Mohaupt | 166/63 |
| 4,579,037 | A | * | 4/1986 | Gillum | 89/180 |
| 4,754,705 | A | | 7/1988 | Worsey | 102/333 |
| 4,886,126 | A | | 12/1989 | Yates, Jr. | 175/4.54 |
| 4,900,092 | A | | 2/1990 | Van Der Westhuizen et al. | 299/13 |
| 5,098,163 | A | | 3/1992 | Young, III | 299/13 |
| 5,192,819 | A | | 3/1993 | Baumgartner | 86/20.15 |
| 5,211,224 | A | | 5/1993 | Bouldin | 166/63 |
| 5,247,886 | A | | 9/1993 | Worsey | 102/312 |
| 5,253,586 | A | | 10/1993 | Worsey | 102/313 |
| 5,308,149 | A | | 5/1994 | Watson et al. | 299/13 |
| 5,394,634 | A | * | 3/1995 | Vang | 42/79 |
| 5,482,754 | A | | 1/1996 | Crook | 428/54 |
| 5,564,499 | A | | 10/1996 | Willis et al. | 166/299 |
| 5,573,307 | A | | 11/1996 | Wilkinson et al. | 299/14 |
| 5,622,098 | A | | 4/1997 | Piper | 92/128 |
| 5,670,737 | A | | 9/1997 | Mey | 102/302 |
| 5,675,107 | A | * | 10/1997 | Ledys et al. | 89/14.3 |
| 5,765,923 | A | | 6/1998 | Watson et al. | 299/13 |
| 5,779,031 | A | | 7/1998 | Moraine et al. | 206/3 |
| 5,789,694 | A | | 8/1998 | Mey | 86/20.15 |
| 5,803,550 | A | | 9/1998 | Watson et al. | 299/13 |
| 5,803,551 | A | | 9/1998 | McCarthy | 299/13 |
| 5,900,578 | A | * | 5/1999 | Wathen | 102/302 X |
| 6,035,784 | A | * | 3/2000 | Watson | 102/312 X |

OTHER PUBLICATIONS

Product advertisement; "Boulder Buster"; 2 pages.

McCarthy; "Hydro–Fracturing Technology for Secondary Rock Breaking"; *Eighth High–Tech Seminar*; 7/98; pp. 45–60.

Clark et al.: "Rapid Excavation of Rock with Small Charges of High Explosive"; Jan. 1979; 231 pages.

Habeck et al.; "Hydro–Fracturing: Propellant Based Rock Breaking An overview of the technology and it s underground applications"; Manfred Habeck, Swartklip Products, South Africa; 62 pages.

Bligh; "Principles of Breaking Rock Using High Pressure Gases"; *Reports of Current Research*; 1974; pp. 1421–1427.

* cited by examiner

SMALL CHARGE BLASTING APPARATUS INCLUDING DEVICE FOR SEALING PRESSURIZED FLUIDS IN HOLES

RELATED APPLICATIONS

This application claims the benefits under 35 U.S.C. § 119(e) from U.S. Provisional Patent Application No. 60/124274 entitled "SMALL CHARGE BLASTING APPARATUS INCLUDING DEVICE FOR SEALING PRESSURIZED FLUIDS IN HOLES" filed Mar. 11, 1999, which is incorporated herein by reference in its entirety.

FIELD OF THE INVENTION

The present invention is directed generally to devices for small charge blasting of rock and other hard materials and specifically to devices for sealing pressurized fluids in holes in the rock and other hard materials.

BACKGROUND

In mining and civil excavation work, small charge blasting or controlled fracture techniques are being introduced as alternatives to conventional drill-and-blast, mechanical breakers, chemical expansion agents and in some cases hand methods. "Small-charge blasting" as used herein includes any excavation method where relatively small amounts of an energetic substance (typically a few kilograms or less) are consumed for each hole in a rock breaking sequence as well as any method in which a pressurized fluid such as a gas, liquid, or foam, is sealed in the bottom of a drill hole to initiate and propagate a fracture. "Sealing" refers to the partial or total blockage of the hole to impede the escape of the pressurized fluid from the hole. Examples of small charge blasting devices and methods are described in U.S. Pat. Nos. 5,765,923; 5,308,149, and 5,098,163.

In many small charge blasting methods, a machine drills a hole into the rock to be broken and then inserts a stemming bar or gun-like barrel into the hole. A pressurized working fluid, such as a gas, water, or foam, is released rapidly into a portion of the hole, usually the bottom portion. The pressurized fluid is typically generated by combustion of a propellant or explosive source, by electrical discharge into a conductive fluid, by inducing a rapid phase change or by mechanical compression of a working fluid. The stemming bar or barrel seals and stems the pressurized fluid in the hole bottom and thereby causes fracturing of the rock. Small charge blasting can be highly mechanized and automated to increase productivity, can permit excavation machinery to remain near the face due to reduced fly rock discharge, and can have a seismic signature that is relatively small because of the small amount of blasting agent used in the blasting sequence.

In designing a small charge blasting apparatus, there are a number of objectives. For example, the apparatus should be able to excavate rock at as low a cost as possible to make it commercially viable. This means that it should excavate rock efficiently in the desired quantities; it should have a low per-shot consumable cost (energetic substance and cartridge); and it should be capable of fast cycle times (drill, shoot, scale, and muck). The sealing device employed in the apparatus should inhibit and control leakage of pressurized working fluid from the hole bottom to enable the cartridge to use the least amount of energetic substance (e.g., explosives or propellants) for generating the pressurized working fluid and initiating and propagating controlled fractures. In penetrating cone fracture techniques, for example, the pressure from the working fluid in the hole bottom should be maintained at high levels (about 50,000 to about 75,000 psi typical) for long periods (2 to 6 milliseconds typical) to break hard rock. To achieve such a pressure profile, a practical down hole sealing method should be relatively easy to operate and able to seal against rock walls of unknown condition. The apparatus should be designed to operate effectively in the presence of extraneous downhole fluids, such as water and/or mud. The presence or absence of such fluids cannot generally be controlled. Extraneous fluids not only can remove volume available for expansion of the working fluid and therefore contribute to unnecessarily and often unacceptably high downhole pressures but also can plug the barrel of the apparatus causing the barrel to be damaged during release of the pressurized working fluid into the hole. Finally, the apparatus should be of robust construction and easy to use.

SUMMARY OF THE INVENTION

These and other objectives are realized by the apparatuses and methods of the present invention.

In a first embodiment of the present invention, a small charge blasting system for breaking hard materials is provided that includes:

(a) a chamber for receiving an energetic substance; and (b) a barrel in communication with the chamber for extending into a hole in the material and releasing a pressurized working fluid (e.g., a gas, foam, or liquid) generated by the energetic substance into the hole to initiate and propagate a fracture in the material. The energetic substance can be a propellant, explosive, a fluid energized by electrical discharge, or a fluid that is caused to undergo a rapid phase change from liquid to gas.

The barrel has a bore having a first cross-sectional area normal to the bore's central axis at an interior (or uphole) portion of the bore and a second cross-sectional area normal to the bore's central axis at or near an exterior (or downhole) end portion of the bore. The first cross-sectional area is less than the second cross-sectional area which provides an expanded volume (a "relief volume") (that is preferably substantially free of the energetic substance) at or near the downhole end of the bore for controlled expansion of the pressurized working fluid in the bore prior to release of the working fluid in the hole; that is, the diameter of the interior portion of the bore is less than the diameter of the downhole end portion of the bore to provide the expanded volume. The second cross-sectional area is preferably at least about 300% and more preferably at least about 400% and even more preferably ranges from about 300% to about 1700% of the first cross sectional area. The diameter of the interior portion of the bore is preferably no more than about 60%, more preferably no more than about 45%, and even more preferably ranges from about 25 to about 45% of the diameter of the hole bottom. The diameter of the downhole end portion of the bore is preferably no more than about 80%, more preferably no more than about 75%, and even more preferably ranges from about 50% to about 75% of the diameter of the hole bottom. Both the interior and exterior portions are located at a distance from the discharge opening of the barrel. The system can be simple in design and operation, of robust construction, and highly effective in breaking rock, particularly hard rock. The use of the relief volume permits controlled pressurization of the bottom of the hole by the working fluid and thereby prevents over pressuring the hole and causing the rock wall to fail in hoop tension. Once this occurs, longitudinal fractures may form which become additional leakage paths for the pressurizing fluid. In addition, the rock walls expand faster than the steel walls of the barrel which tends to increase the leakage gap during pressurization.

Controlled hole pressurization thus can facilitate more effective formation and propagation of fractures in the material to be broken, which reduces operating costs and permits the use of relatively low amounts of the energetic substance in the cartridge.

The relief volume in the downhole end of the bore is measured relative to a reference volume that is equal to the cross-sectional area of the hole bottom (normal to the longitudinal axis of the hole) times a depth equal to the hole diameter (hereinafter "the reference volume"). The internal relief volume preferably ranges from about 25% to about 125%, more preferably from about 40% to about 100%, and even more preferably from about 50% to about 75% of the reference volume.

The transition from the first cross-sectional area to the enlarged second transitional area is preferably made gradually using an outward curve or taper. The angle of taper (measured relative to a line parallel to the longitudinal axis of the bore) preferably ranges from about 10 to about 60 degrees, more preferably from about 15 to about 50 degrees, and even more preferably from about 20 to about 40 degrees.

The exterior of the distal end of the barrel forms a dynamic seal in the hole and thereby impedes leakage of pressurized working fluid during hole pressurization by allowing only a small annular gap (or sealing gap) between an outer portion of the barrel (the sealing band) and the sidewall of the hole. The gap may not be of uniform dimensions around the hole. Consider the cross-sectional area of the hole bottom normal to the longitudinal hole axis as a reference area (hereinafter "the reference area"). The gross area of the annular gap is preferably no more than about 5% of the reference area, more preferably no more than about 3% of the reference area, and even more preferably no more than about 2% of the reference area. Although a perfect seal is desired, it is difficult to form a perfect seal against a rock wall having an irregular and often times chipped surface. Preferably, the amount of pressurized working fluid that escapes from the hole during hole pressurization (from the time the pressure in the hole is applied through the time the fracture has propagated to completion) is no more than about 50%, more preferably no more than about 30%, and most preferably no more than about 15% of the total pressurized working fluid generated. The average pressure maintained in the hole bottom preferably ranges from about 50% to about 500%, more preferably from about 100% to about 400%, and most preferably from about 100% to about 250% of the confined tensile strength of the rock.

The downhole end of the barrel preferably contacts the bottom of the hole prior to release of the pressurized fluid into the hole to ensure that proper sealing takes place. If the end of the barrel did not contact the bottom of the hole, it could be difficult to ensure that the barrel is positioned close enough to the bottom of the hole for proper pressurization of the hole bottom.

For more effective sealing in some applications, the thickness of an interior portion of the barrel wall at the downhole end of the barrel can be less than the thickness of the barrel wall on either side of the interior portion to permit the interior portion of the barrel wall to expand or flex elastically (relative to the adjacent wall portions) in response to pressure exerted on the wall of the bore by the pressurized fluid to reduce or close the external leakage gap. To facilitate expansion of the interior barrel portion, the downhole end of the bore can include an inwardly projecting lip to decrease the cross-sectional area of flow at the lip compared to the cross sectional area of flow in the bore and thereby restrict the release of the pressurized fluid from the end of the barrel. Preferably, the thickness and strength of the interior portion are selected such that from about 25% to about 100%, more preferably from about 50% to about 100% and even more preferably from about 75% to about 100% of the gap is closed by elastic expansion of the interior portion. Preferably, the thickness of the interior portion of the barrel that expands outwardly is no more than about 75%, more preferably no more than about 60% and even more preferably ranges from about 20% to about 60% of the thickness of the barrel wall in either of the adjacent (substantially nonexpandable) barrel wall portions.

In a second embodiment, the small charge blasting system includes an end cap on a downhole end of the barrel to substantially seal the bore during drilling of the hole and during inserting of the barrel into hole from substances, such as extraneous downhole fluids (e.g., water and mud). The pressurized working fluid dislodges the end cap from the wall of the bore and/or ruptures or shatters the end cap to permit the pressurized working fluid to escape into the bottom of the hole. The end cap can significantly reduce the detrimental effects of extraneous fluids and other debris on hole pressurization.

The end cap is preferably sufficiently strong to resist force exerted on the end cap by extraneous fluids in the hole bottom but not to resist the force exerted on the end cap by the pressurized working fluid. Preferably, the end cap shatters into a number of relatively small pieces from the force exerted on the end cap by the pressurized working fluid so that the pieces of the end cap do not interfere with the flow of pressurized working fluid into the fracture initiated in the pressurized portion of the hole bottom. Preferably, the tensile strength of the end cap is no more than about 2,500 psi (17 MPa). The end cap is preferably composed of a material such as polypropylene, polycarbonate, polyethylene or a co-polymer combination that will shatter into a number of smaller pieces.

In a third embodiment of the present invention, the barrel of the small charge blasting device has a portion of its outer surface that is stepped, curved, or tapered inwardly near the downhole end of the barrel to provide an annular volume between the outer surface of an inwardly offset portion of the barrel and the sidewall of the hole so that the pressurized working fluid can pressurize not only the hole bottom but also the sidewall of the hole near the hole bottom. The annular volume adjacent to the inwardly offset portion of the outer surface preferably ranges from about 2% to about 25%, more preferably from about 4% to about 20%, and most preferably from about 5% to about 15% of the reference volume. The annular gap width around the offset or reduced diameter portion of the barrel typically ranges from about 3 to about 10% of the diameter of the hole bottom.

While not wishing to be bound by any theory, it is believed that more effective and efficient penetrating cone fracture formation (PCF) occurs when both the hole bottom and a portion of the sidewall of the hole are pressurized. The pressure induces radial compressive and tangential stresses in the sidewall and compressive stress in the rock below the bottom of the drill hole.

If more than a small portion of the sidewall of the hole is pressurized, conditions for the PCF stress concentration may not, however, be substantially improved. Pressurization of too much of the sidewall of the hole can result in the hole being pressurized where a pre-existing fracture intercepts the hole. The pre-existing fracture may be propagated in preference to initiating and propagating a PCF fracture such that less rock is broken. The length of the inwardly offset portion of the barrel from the downhole end of the barrel preferably ranges from about 25% to about 150%, more preferably from about 30% to about 100%, and most preferably from about 50% to about 100% of the diameter of the hole bottom. The hole typically ranges from about 3 to about 10 hole diameters in depth.

DETAILED DESCRIPTION

Controlling Pressurization of the Hole by the Working Fluid

Figure 1:
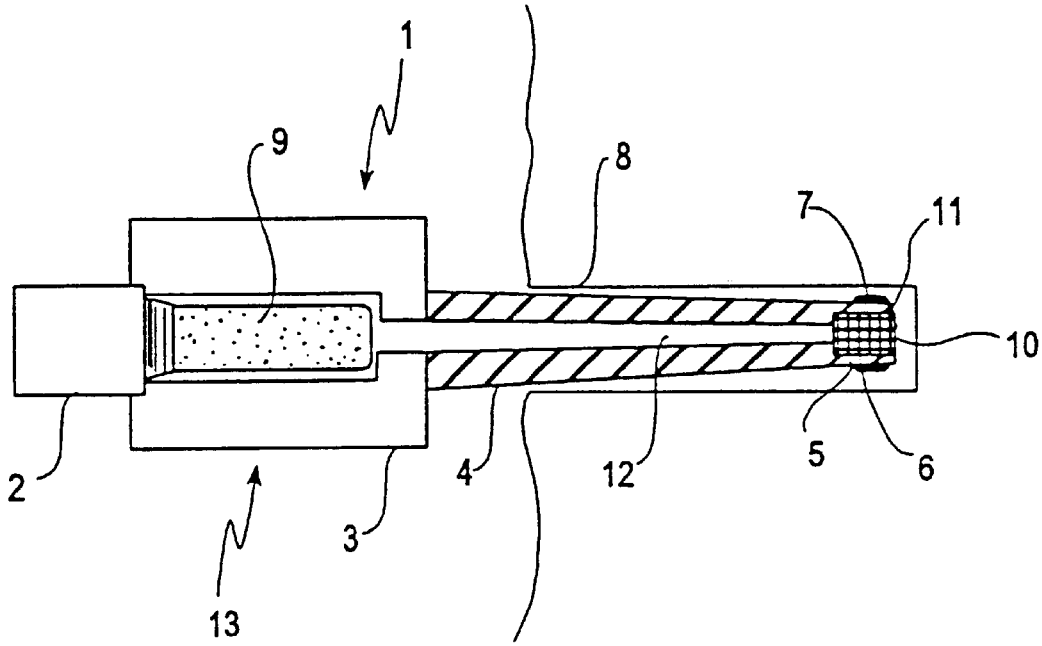
FIG. 1 is a cross-sectional side view of a gas-generator apparatus according to the first embodiment of the present invention.

In the first embodiment of the present invention, a relief volume is provided in the downhole (muzzle) end of a gas generator to provide controlled expansion of the pressurized working fluid. FIG. 1 shows a gas-generator 1 comprised of a breech 13 located outside a hole 8 and a barrel 4 located in the hole. The breech 13 includes a breech block 2 and a combustion chamber 3. The tip 11 of the muzzle 5 includes a relief volume 6 (depicted by cross-thatching) and a sealing surface or sealing band 7. In this type of gas-generator, only the barrel 4 (and not the breech) is inserted into the drill hole 8. In other configurations, the breech may be located in the hole with the barrel. A high pressure gas is generated by a cartridge 9 located in the combustion chamber 3. The high pressure gas expands down the bore 12 of the barrel 4, exits the muzzle 5, and pressurizes the hole bottom 10.

Figure 2:
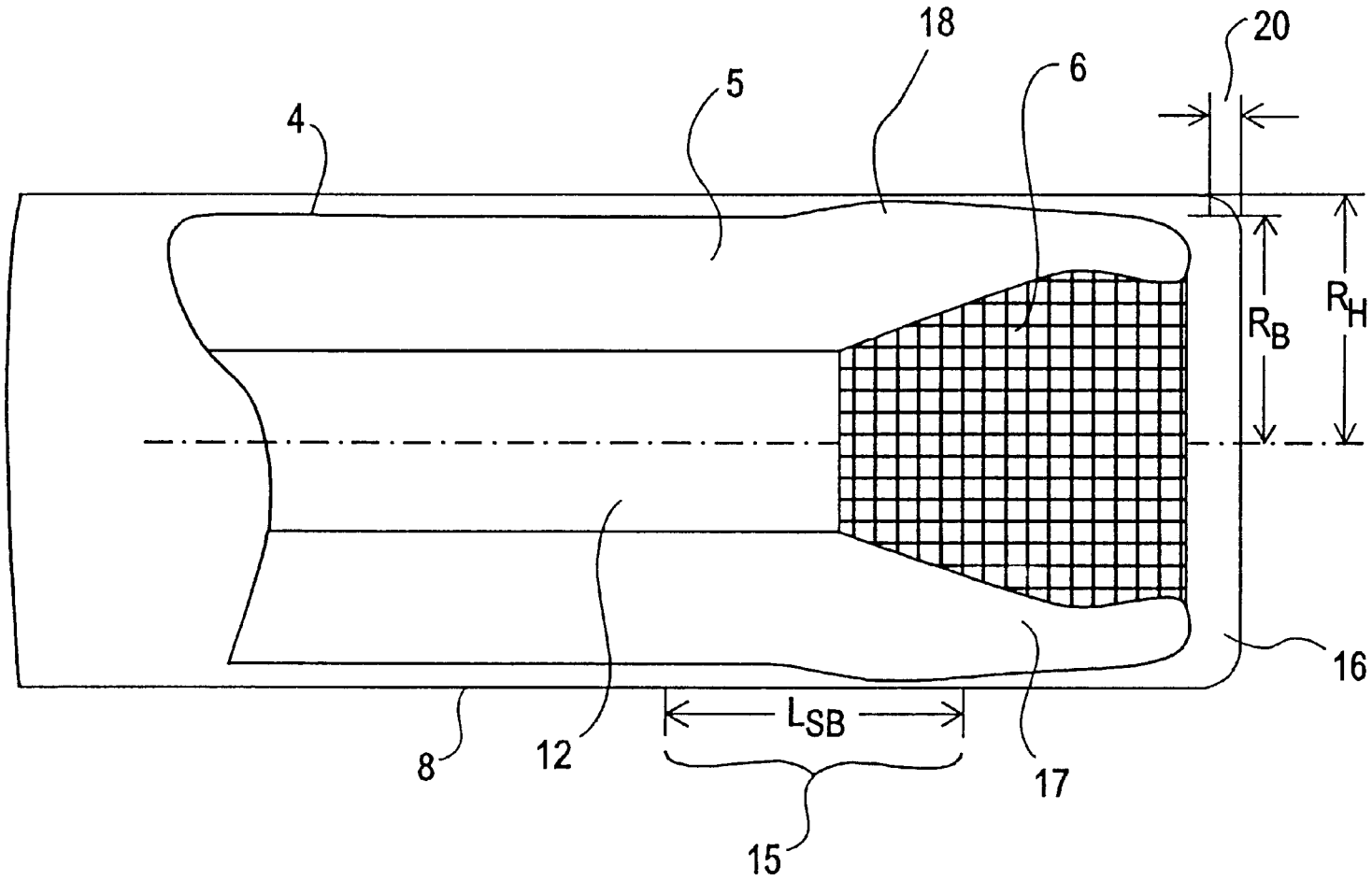
FIG. 2 is an enlarged cutaway side view of the distal or downhole end of the gas injector of FIG. 1.

FIG. 2 shows the muzzle end 5 of the barrel 4 of the first embodiment in an enlarged view. The internal bore 12 of the barrel 4 transitions into a relief volume 6 near the muzzle end. The transition is preferably gradual such as by a tapered or curved surface 17 and not by an abrupt step. The muzzle end 5 is inserted into the bottom of the drill hole 8. The outside radius "$R_B$"of a sealing band portion 15 of the muzzle end 5 is slightly less than the radius "$R_H$" of the hole wall leaving a gap 18 through which any pressurized working fluid in the hole bottom 10 must pass to leave the hole bottom 10. The distance 20 between the muzzle tip and the bottom of the hole is called the standoff distance. The bottom edge 16 of the muzzle tip is rounded to permit the working fluid to flow around the edge 16 and into the gap 18.

The relief volume at the downhole end of the bore permits controlled pressurization of the bottom of the hole by the working fluid to create substantially optimum conditions for initiating and propagating a controlled fracture at the hole bottom. The pressurized volume generally is the sum of (1) the internal cartridge volume, (2) the internal barrel volume, including the relief volume at the muzzle end of the barrel, and (3) the available hole bottom volume outside the muzzle that is effectively sealed by the sealing band. The pressure of the working fluid in the hole bottom is controlled approximately by the mass of pressurized fluid, the energy released by the pressurized working fluid, and the total available volume for expansion of the fluid (i.e., volumes (1), (2) and (3) above). This is particularly the case where the fluid conditions are more or less uniform throughout the available volume.

By way of example for a long barrel (e.g., a cartridge located in a breech positioned outside the hole), the pressure energy developed in the cartridge from the working fluid is converted to kinetic energy as the working fluid expands down the barrel. When the fast-moving working fluid is abruptly brought to rest at the bottom of the hole, there will be an irreversible conversion of kinetic energy to pressure energy resulting in a controlled high pressure pulse. In this case the relief volume serves to provide sufficient expansion volume for the working fluid to limit the rise in pressure in the hole bottom thereby protecting the barrel structure and hole walls from being damaged by over-pressurization.

Figure 3:
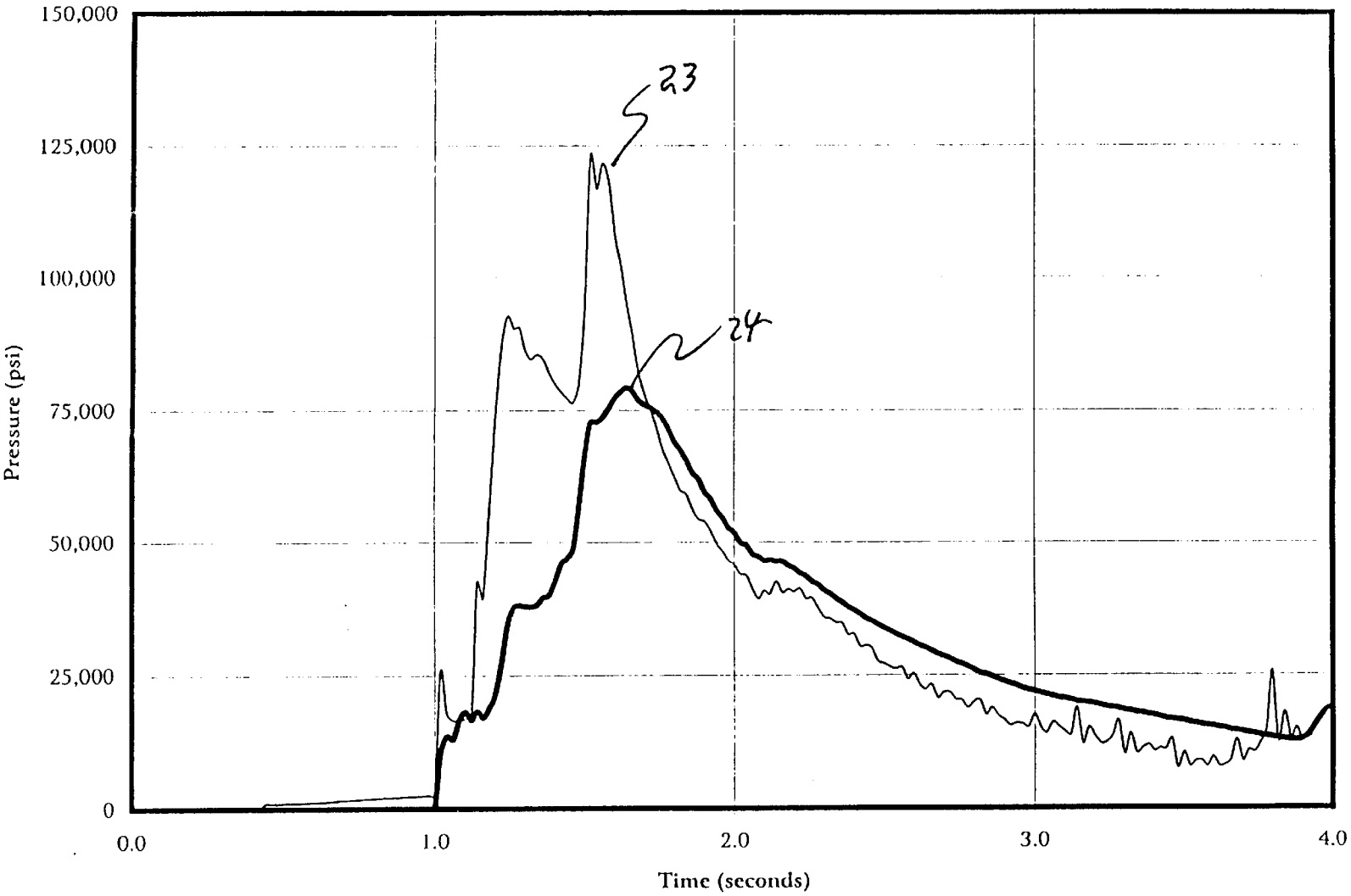
FIG. 3 is a plot providing comparative pressure histories for the gas-generator barrel of FIG. 1 and a gas-generator without an internal relief volume.

FIG. 3 illustrates the impact of the relief volume on the hole pressurization. FIG. 3 is a representative plot of the pressure (vertical axis) in the hole bottom 10 as a function of time (horizontal axis) for a gas-generator geometry such as that shown in FIG. 1. For the case of a barrel with no relief volume 6 and no standoff distance from the hole bottom, the peak pressure 23 may be very high and is capable of damaging the muzzle end of the barrel. For the case of a barrel with a substantial relief volume 6, and no standoff distance from the hole bottom (e.g., the device of FIG. 1), the peak pressure 24 is substantially less and is controlled so that it will not damage the muzzle end of the barrel.

Referring again to FIGS. 1 and 2, the pressurized working fluid will fill the entire bottom of the hole even if the muzzle end 5 of the barrel initially rests on the hole bottom 10. This is so because the muzzle will begin recoiling off the hole bottom as soon as pressure is developed in the cartridge but before significant pressure is applied at the hole bottom 10. Further, as the relief volume 6 is pressurized, the edge 11 retracts due to Poissons ratio effects on the internal barrel structure. Because of these effects and because the edge 11 of the muzzle is radiused, at least a small length of the entire hole bottom 10 is pressurized in a way to create conditions for a PCF-type fracture.

Sealing of the Working Fluid in the Hole

Figure 4:
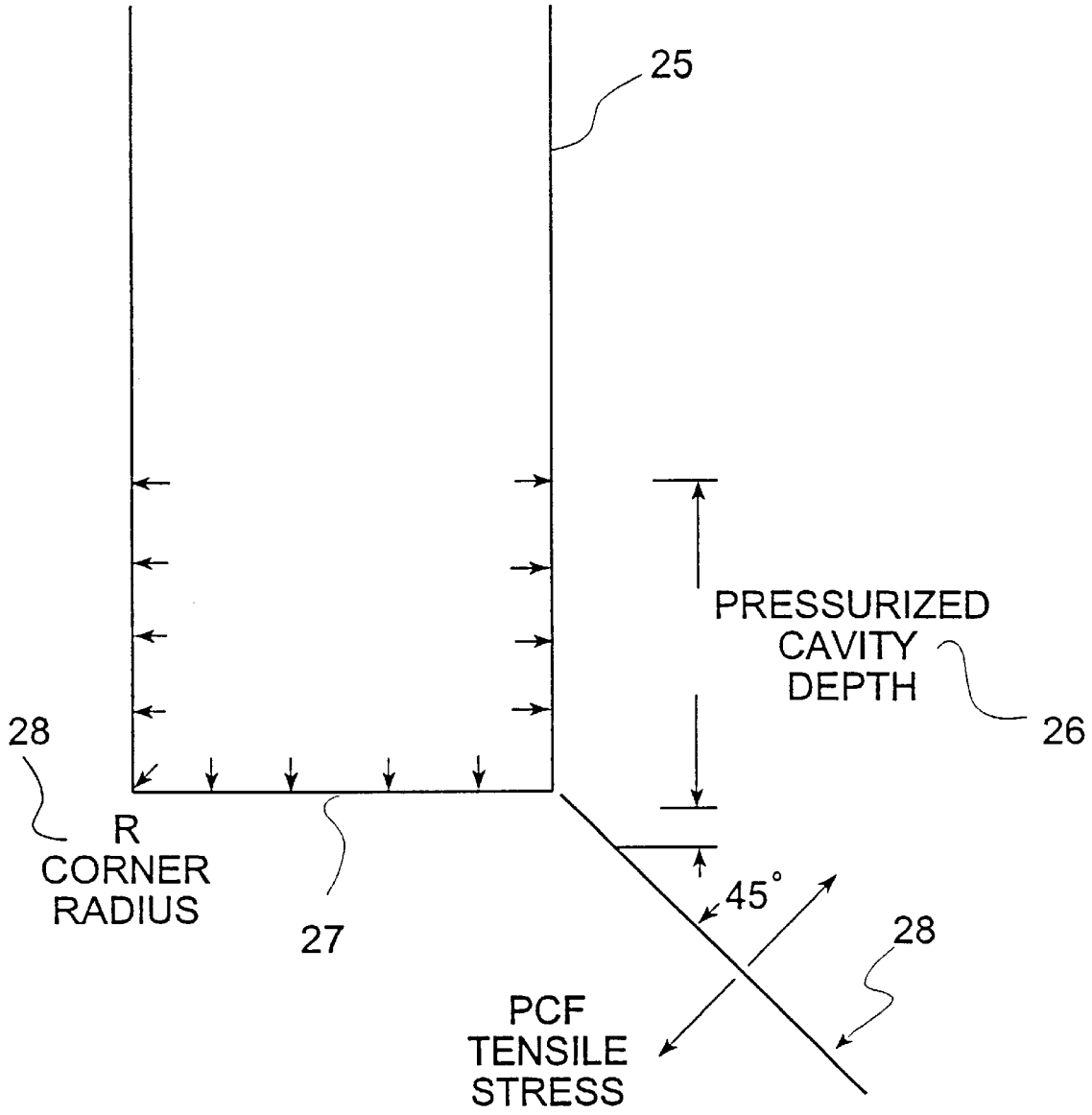
FIG. 4 is a cutaway side view of a hole illustrating the common down hole pressure profile that creates a PCF stress concentration.

FIG. 4 illustrates the stress concentration that forms a controlled fracture, such as a PCF-type fracture. FIG. 4 shows the geometry of a blind hole and the stresses that are set up by pressurizing only the bottom of the hole. The drill hole 25 is pressurized only over a depth 26. The bottom 27 of the drill hole has a radiused corner 28. The pressure induces radial compressive and tangential tensile stresses (i.e., hoop tension) in the rock sidewalls of the hole 25. The pressure induces compressive stresses in the rock below the hole bottom 27. The result is a complex stress field in the rock around the corner. There are tensile stresses induced along a line 28 emanating approximately 45 degrees downward from the corner of the hole bottom 27. The tensile stresses along this line are highest at the corner of the hole bottom 27 and diminish along the line 28 with distance from the hole bottom. The tensile stresses are sufficiently high as to initiate a fracture at the corner of the hole bottom 27, typically along the line 28. If there are in-situ stresses already present in the rock, they will modify the stress field and change the orientation of the line across which there is tensile stress.

The key to maintaining the pressure in the hole bottom for a sufficient time to allow the PCF stress concentration in FIG. 4 to develop is to provide adequate sealing of the pressurized gas in the hole bottom using the sealing band 7. Pressurization of the hole bottom is a transient event lasting on the order of 2 to 6 milliseconds for an 89-mm hole diameter hole bottom. Effective sealing requires maintaining the pressure at approximately the desired level for a duration of at least several milliseconds. This can be done by forming a perfect seal but this is difficult to achieve against a rock wall that may have chips out of it or small fractures straddling the sealing band. Alternately, effective sealing can be achieved by restricting the amount of gas that can escape from the hole bottom during the several milliseconds and by providing enough additional gas to compensate for the leakage. The gas can only escape past the sealing band which minimizes the gap between the barrel and the sidewall of the hole.

Referring again to FIG. 2, the sealing gap 18 envisioned for the gas generator of the first embodiment consists of a portion of the downhole tip of the muzzle that is as close to the diameter of the hole as possible and of a preferred length "$L_{SB}$" ranging from about 0.25 to about 1 hole diameters. The actual gap width will be a function of the over break in the rock walls caused by the drill bit in forming the hole bottom and the amount of wear in the drill bit. As shown in FIG. 2, the barrel diameter uphole from the sealing band portion 15 is less than the diameter of the sealing band portion to permit the length of the barrel to be inserted into the hole, which is usually not drilled perfectly straight and uniform.

Figure 5:
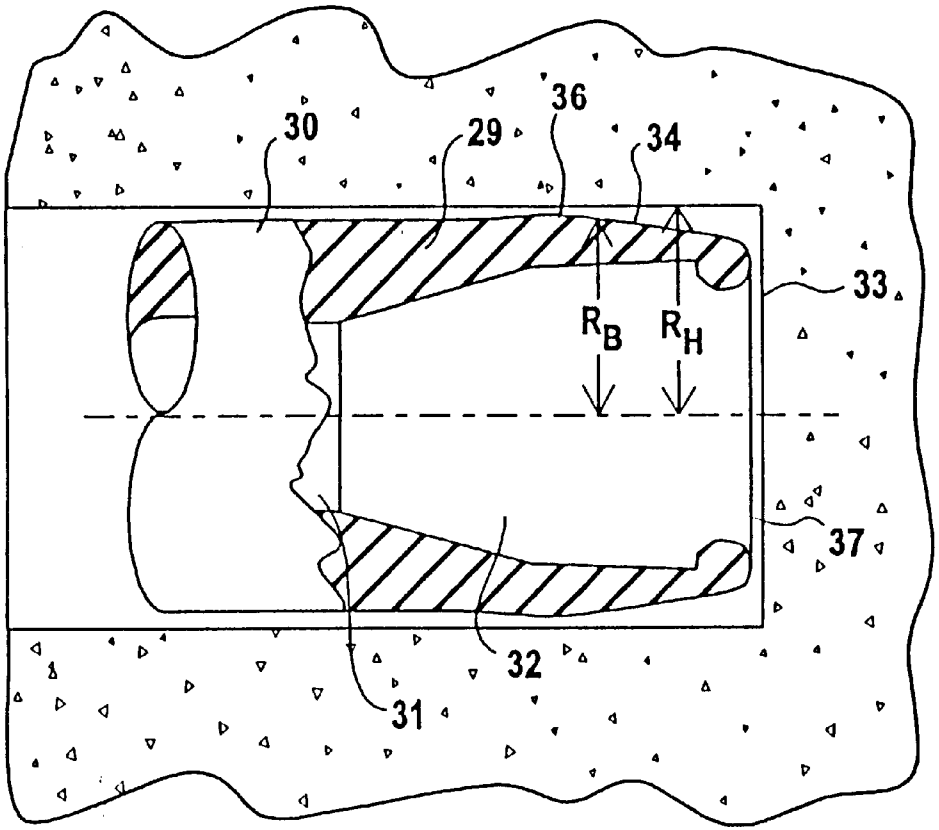
FIG. 5 is an enlarged cross-sectional side view of a muzzle of another configuration of gas generator.

FIG. 5 shows the muzzle end 29 of the barrel 30 for a variation of the gas generator of the first embodiment. The internal bore of the barrel 31 transitions into a relief volume 32 near the muzzle end. The muzzle end 29 is inserted into the bottom of a drill hole 33. The outside radius "$R_B$" of the muzzle end 29 is slightly less than the radius "$R_H$" of the sidewall of the hole leaving a gap 36 through which any pressurized fluid in the hole bottom 37 must pass to leave the hole bottom. The outside surface 34 of the muzzle end 29 is slightly tapered inwardly to allow it to be inserted into a range of hole diameters in a stepped drill hole geometry. The range of hole diameters can be caused by drill bit wear and/or overbreak of the rock by the drilling process. The angle of taper commonly ranges from about 0.5 to about 3 degrees.

Figure 6A:
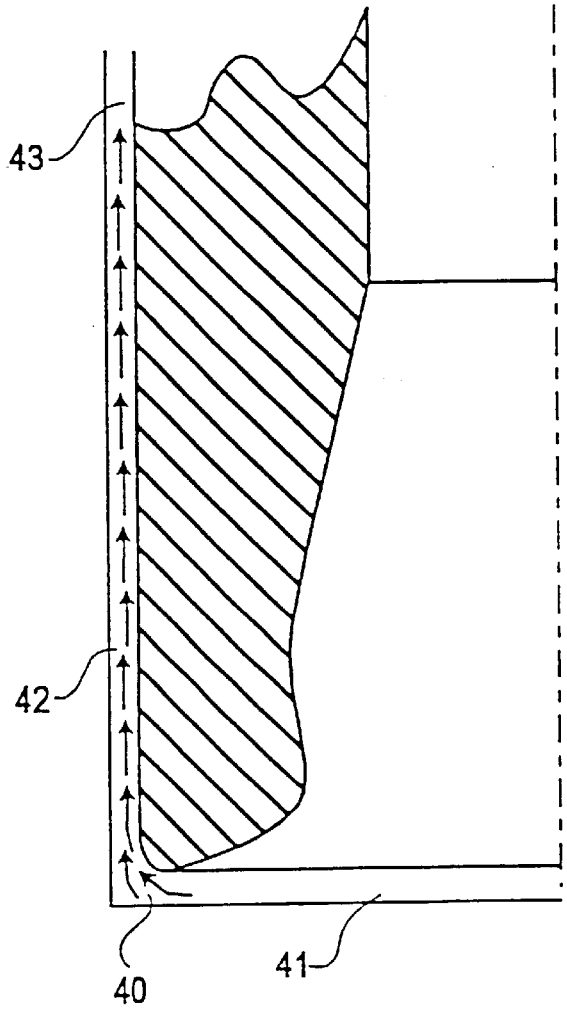
FIGS. 6A and B are a respectively a cutaway side view of the muzzle of the gas generator of FIG. 1 and a model for the gas leakage mechanism in the sealing gap.
Figure 6B:
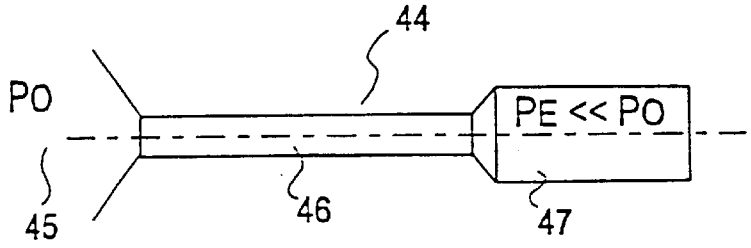

The physics of the leakage of working fluid through the sealing gap 36 are dictated by the general unsteady flow equations for an adiabatic fluid. FIGS. 6A and B illustrate the gas dynamic principles that govern the leakage of gas from the pressurized region of the hole bottom. The pressurized gas 40 in the hole bottom 41 flows into the annular gap 42 and on out into the hole above point 43 which is initially at atmospheric pressure. This process can be modeled by using the unsteady adiabatic flow equations for a geometry 44 which shows a large reservoir of high pressure gas 45 emptying into a smaller diameter duct 46 and thereafter into an expansion volume 47 at an exit pressure much lower than the reservoir pressure. This process can be adequately computed using the assumptions of 1-D inviscid flow. This computation can be carried out using one of a number of available explicit finite difference computer codes. By applying these general unsteady flow equations, it has been established that the annular cross-sectional area of this gap should be no more than about 5% of the cross sectional area of the hole bottom. To compensate for the leakage through the gap, these calculations indicate that the leakage can be overcome by providing from about 10% to about 25% additional mass of pressurizing working fluid in the hole bottom.

The above relief volume and sealing means are effective for the case of the muzzle tip initially resting on the hole bottom. Generally, if the muzzle tip is initially within about 0.5 to about 1 hole diameters off the hole bottom, the hole pressurization will still be effective. This is so because the extra gas expansion volume is not large compared to the total available gas expansion volume and the extra length of hole pressurized will cause a greater PCF stress concentration which will help compensate for the somewhat reduced hole bottom pressures. However, the length of the hole bottom at the same diameter should be such that the sealing surface on the rock walls will be preserved with such a stand-off distance and will still have allowance for recoil motion during the rock fragmentation event.

Flex Seal

Figure 7:
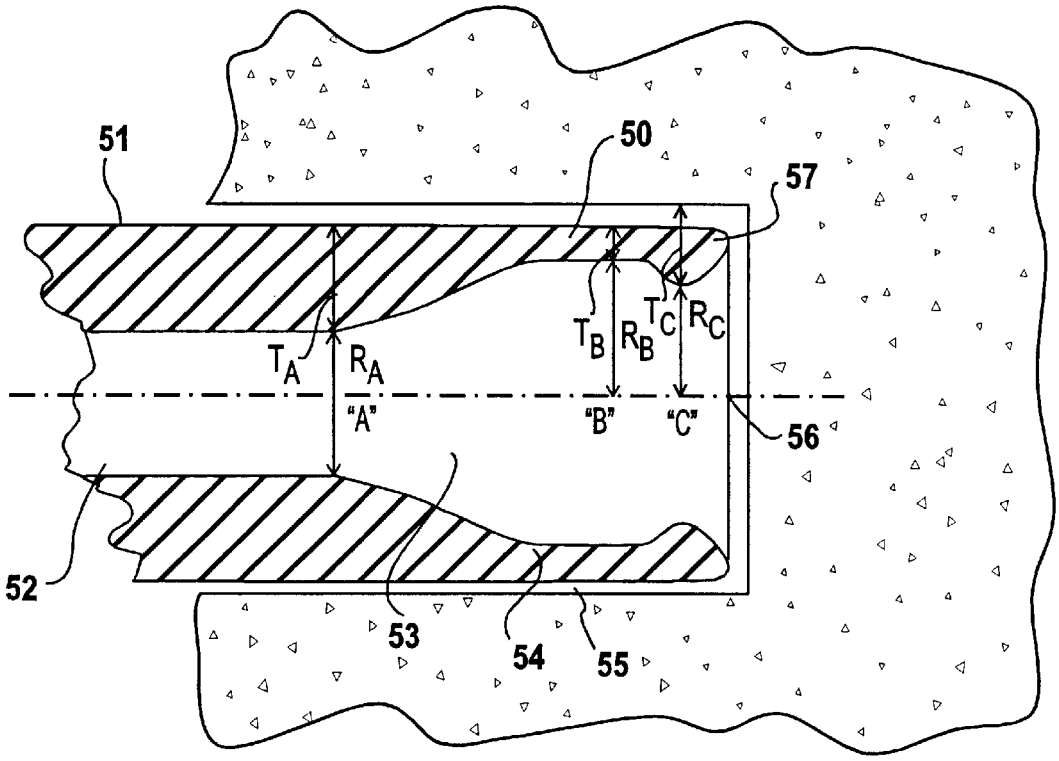
FIG. 7 is an enlarged cross-sectional side view of a muzzle of another configuration of gas generator.

FIG. 7 shows the muzzle end 50 of a barrel 51 having a flex seal configuration. The internal bore 52 of the barrel 51 transitions into a relief volume 53 near the muzzle end of the barrel. The relief volume 53 is contoured to create a thin section 54 which can flex elastically outward under the pressure in the relief volume 53 so as to reduce or close down the gap 55 and further restrict the flow of gas from the pressurized hole bottom 56.

The reduced diameter portion or lip 57 at the muzzle exit will momentarily increase the internal pressure in the relief volume to increase the rate of flexing so that the sealing gap will be reduced or closed before the arrival of the high pressure working fluid at the gap on the outside of the barrel. This reduced diameter portion at the muzzle exit can strengthen the muzzle structure and increase the barrel's useful working life.

The cross-sectional area of flow in the bore (and the radius "$R_A$" of the bore) at point "A" and the cross-sectional area of flow in the bore (and the radius "$R_C$" of the bore) at point "C" are each less than the cross-sectional area of flow in the bore (and the radius "$R_B$" of the bore) at point "B". Preferably, the radius "$R_B$" ranges from about 120 to about 200% of the radius "$R_C$" and from about 150 to about 300% of the radius "$R_A$."

The thickness "$T_B$" of the barrel wall at point "B" preferably is less than the thicknesses "$T_A$" and "$T_C$" of the barrel wall at points "A" and "C," respectively. More preferably, "$T_B$" is no more than about 45% of "$T_A$" and no more than about 35% of "$T_C$."

The barrel is preferably composed of a material, such as a high-strength alloy steel or maraging steel or stainless steel or a steel suitable for high pressure gun tubes, that has a tensile elastic yield strength of at least about 900 MPa and more preferably ranging from about 1,400 to about 2,500 MPa, to provide the desired elastic properties.

End Cap

Figure 8:
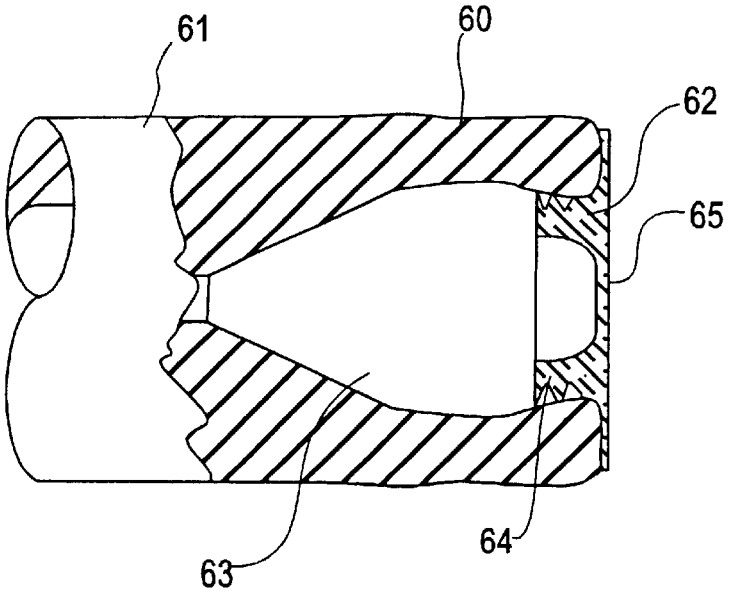
FIG. 8 is an enlarged cross-sectional side view of the gas generator of FIG. 1 with an end cap on the muzzle according to the second embodiment.

FIG. 8 shows the muzzle end 60 of a barrel 61 which is similar to that shown in FIG. 2. An end cap 62 is inserted into the inside of the downhole end of the relief volume 63. The purpose of the end cap 62 is to keep any extraneous liquids and debris that may be in the hole bottom from entering the relief volume 63 prior to initiating the gas-generator cartridge (e.g., cartridge shown in FIG. 1) or from entering the relief volume during drilling. The exposed surface 65 of the end cap 62 may be flat as shown or outwardly convex such as the shape of a dome to give the cap greater strength against the hole bottom fluids as they are forced past the sealing gap.

The cap may be held in place in the internal relief volume by any number of attachment means including but not limited to a friction fit, a barbed or irregular surface (such as that shown in FIG. 8) which makes the end cap easy to install but difficult to remove (such as by rough handling or miscellaneous insertion forces), a pin, a notch or indentation in the barrel and a matching notch or indentation in the end cap, a threaded attachment between the end cap and the inside of the barrel or a clamping mechanism. Insertion should be carried out slowly to permit the fluids to be forced out around the tip of the muzzle.

After the barrel is inserted into the hole and the cartridge is initiated to generate the high energy, high pressure working fluid, the working fluid expands down the bore and dislodges the cap from the bore and/or ruptures or shatters the end cap to permit the pressurized fluid to enter freely the bottom of the hole. The pressurized working fluid then pressurizes any extraneous fluids, forcing them away from the center of the hole and up through the sealing gap. The extraneous fluids, being liquid or slurries, will substantially slow the leakage mass flow rate of the working fluid through the sealing gap which will substantially improve downhole sealing. In this manner, the mass of high energy working fluid will displace most of the extraneous fluids in the hole bottom and will thereafter drive the PCF fracture to completion.

This end cap will also serve another important function when the gas-generator barrel is in close proximity to the rock drill during hole drilling operations. This is commonly the case when an indexer assembly is used to drill holes and index the gas-generator for properly aligned insertion. With an indexer, the rock drill and gas-generator are side by side and therefore in close proximity to one another. The end cap will guard against drilling fluids and/or rock debris from entering and clogging the barrel bore, particularly when drilling upward slanted drill holes.

Reduced Diameter Muzzle Tip

In the third embodiment of the present invention, the distal end of the muzzle tip is modified by reducing its outside diameter to less than that of the sealing band to create substantially optional conditions for initiating and propagating a PFC-type fracture. The sealing band remains upstream of the reduced outer diameter portion so that the full pressure developed in the hole bottom is applied externally to the muzzle tip and the sidewall of the hole around the reduced diameter portion.

Figure 9:
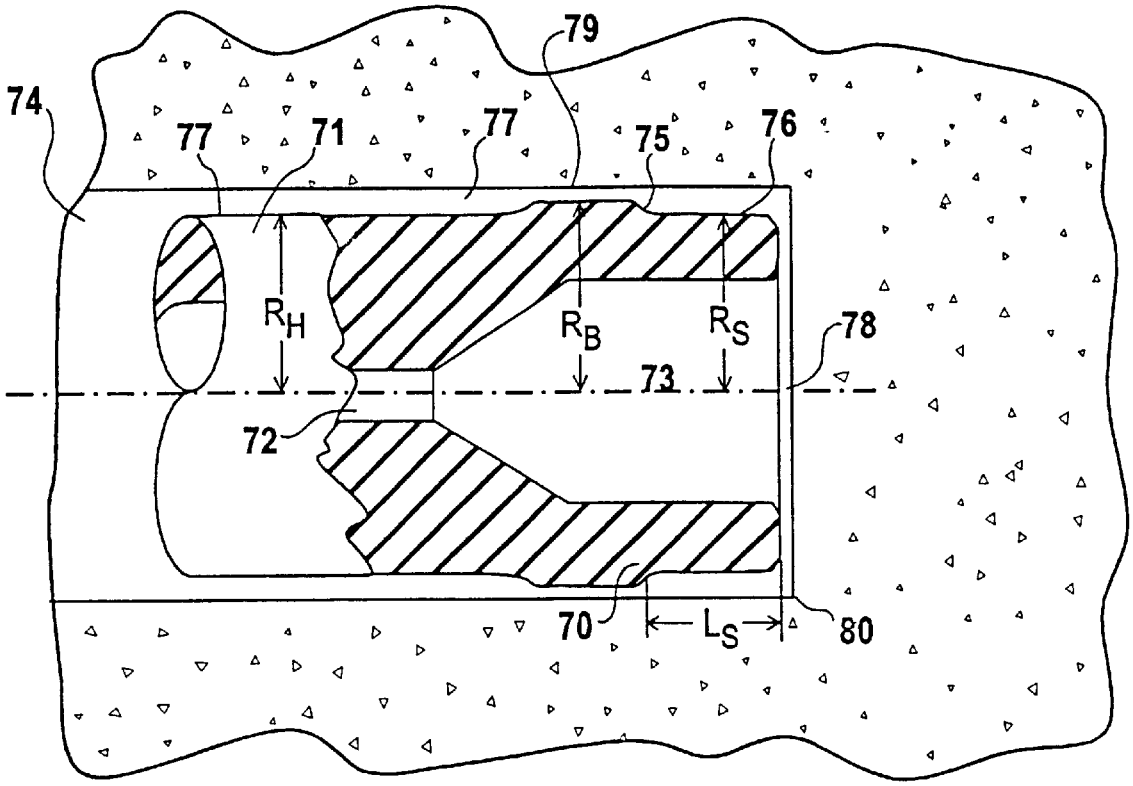
FIG. 9 is an enlarged cross-sectional side view of the muzzle of a gas generator according to a third embodiment.

FIG. 9 shows the muzzle end 70 of the barrel 71 of the third embodiment. The internal bore 72 of the barrel 71 transitions into an internal relief volume 73 near the muzzle end. The muzzle end 70 is inserted into the bottom of a drill hole 74. The outside radius "$R_B$" of the muzzle end 70 is slightly less than the radius "$R_H$" of the hole wall leaving a sealing gap 77 through which any pressurized fluid in the hole bottom 78 must pass to leave the hole bottom. The outside radius "$R_S$" of the inwardly offset portion 76 of the muzzle end 70 is further reduced to allow the fluid pressure in the hole bottom 78 to be applied to the sidewall 79 of the drill hole 74 so that this portion of the sidewall can be put into tangential or hoop tension to help form the controlled fracture at the corner 80 of the bottom of the hole 74. Preferably, $R_S$ is no more than about 90% of $R_H$ and no more than about 88% of $R_B$. A tapered surface 75 (preferably having an angle of taper ranging from about 10 to about 45 degrees) is used to gradually transition the outer barrel radius $R_B$ into the inwardly offset portion radius $R_S$.

The length "$L_S$" of the inwardly offset portion 76 of the barrel (as measured from the tip of the barrel to the end of the tapered surface 75) preferably is at least about 50% and more preferably at least about 100% of the hole radius $R_H$.

The annular volume formed between the reduced diameter portion of the muzzle tip and the sidewall of the hole and the width of the entrance to this volume are both sufficiently large, so that the pressurized fluid in the hole bottom will readily flow into this volume. Thus, the pressure in this annular volume will be essentially the same as the pressure in the hole bottom. However, the width of a sealing gap (around the sealing band) that is adjacent to the annular volume is much smaller and substantially constricts the mass flow of pressurized working fluid into the sealing gap. The fluid flowing through the sealing gap therefore accelerates, converting internal fluid energy to kinetic energy as it escapes from the hole bottom. As a result, the fluid pressure around the sealing gap decreases and becomes much lower than the pressure in the hole bottom or in the larger annular volume around the reduced diameter portion of the muzzle tip.

Stated another way, the annular volume around the inwardly offset portion of the barrel is a large reservoir in substantially good flow communication with the volume represented by the hole bottom. The annular volume around the sealing band is a restricted passage connecting the pressurized down hole volume with the much lower pressure atmosphere. The flow through this restricted passage is choked and the energy of the escaping gas is primarily in the form of kinetic rather than internal energy and is therefore characterized by lower temperature and pressure.

Figure 10:
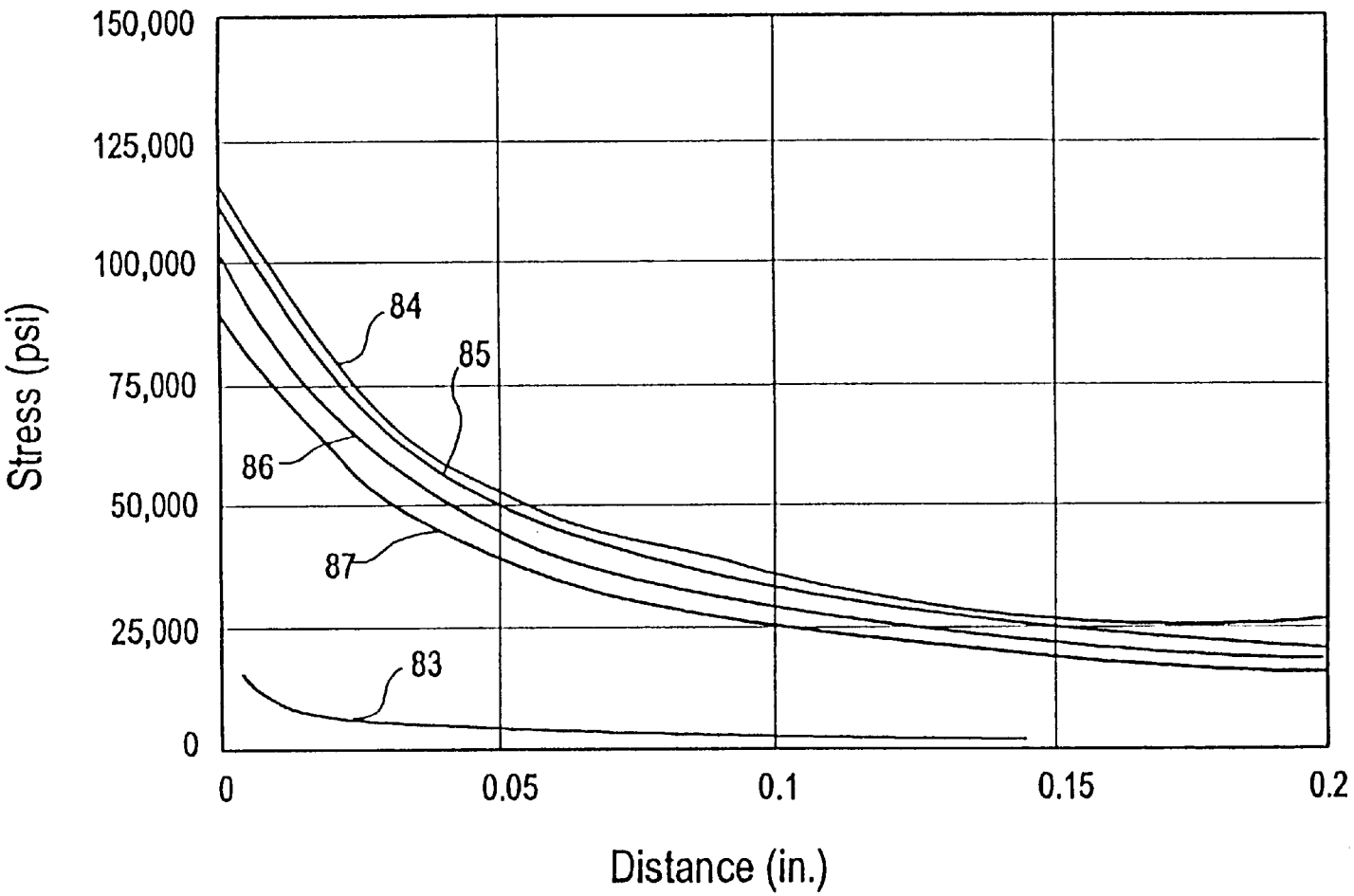
FIG. 10 is a plot showing the PCF stress concentration as a function of the length of pressurized hole bottom.

FIG. 10 depicts the benefits of pressurizing both the sidewall and bottom of the hole. FIG. 10 shows the computed tensile stresses along a line emanating approximately 45 degrees downward from the corner of the hole bottom (see FIG. 4). The tensile stress (vertical axis) is plotted versus distance (horizontal axis) where the origin is at the corner of the hole bottom. These stresses were computed using a finite element code and a hole geometry such as shown in FIG. 4. The properties of the rock were those of a typical granite. The plot also shows the estimated critical fracture initiation stress 83 for the granite. The plot shows the tensile stresses developed in the rock for holes pressurized to a length of L/D=1.24; L/D=0.62; L/D=0.31; and L/D=0.15 (84, 85, 86 and 87 respectively) where D is the diameter of the hole bottom. The tensile stresses increase as the corner of the hole bottom is approached and the tensile stresses are well above the critical fracture initiation stress for the level of hole pressurization used in the calculation. This plot illustrates that the tensile stresses are relatively constant for pressurized lengths of hole greater than an L/D of 0.60. As the length of hole pressurized is reduced from an L/D of 0.60, the tensile stresses begin to diminish significantly. Based on these results, a depth of hole of at least about 0.5 hole diameters should be pressurized to develop near maximum stress concentration conditions. If less than this depth of hole is pressurized, the stress concentration may begin to be significantly diminished as shown in FIG. 10.

If used in a wet or mud filled hole, the end cap of the second embodiment can be used with the barrel of FIG. 9. In that event, the reduced diameter portion of the muzzle tip would be surrounded by water and/or mud. Being fluids, these will be pressurized along with the remainder of the hole bottom such that the function of the reduced diameter tip (i.e., to pressurize the hole sidewall) will still be realized.

Split Sealing Ring

Figure 11A:
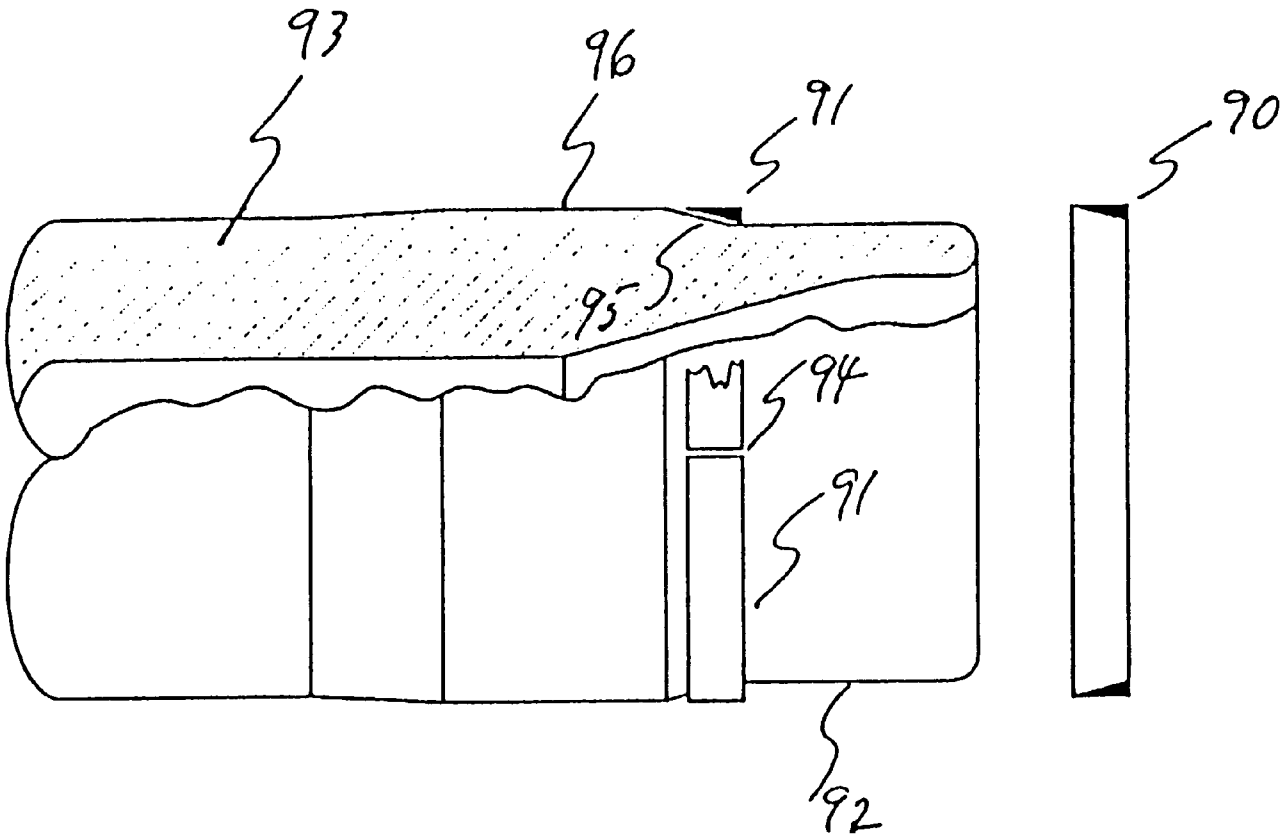
FIG. 11A is an enlarged cross-sectional side view of the muzzle of the gas generator of FIG. 9 showing a split sealing ring on the reduced diameter muzzle tip adjacent to the external sealing band.
Figure 11B:
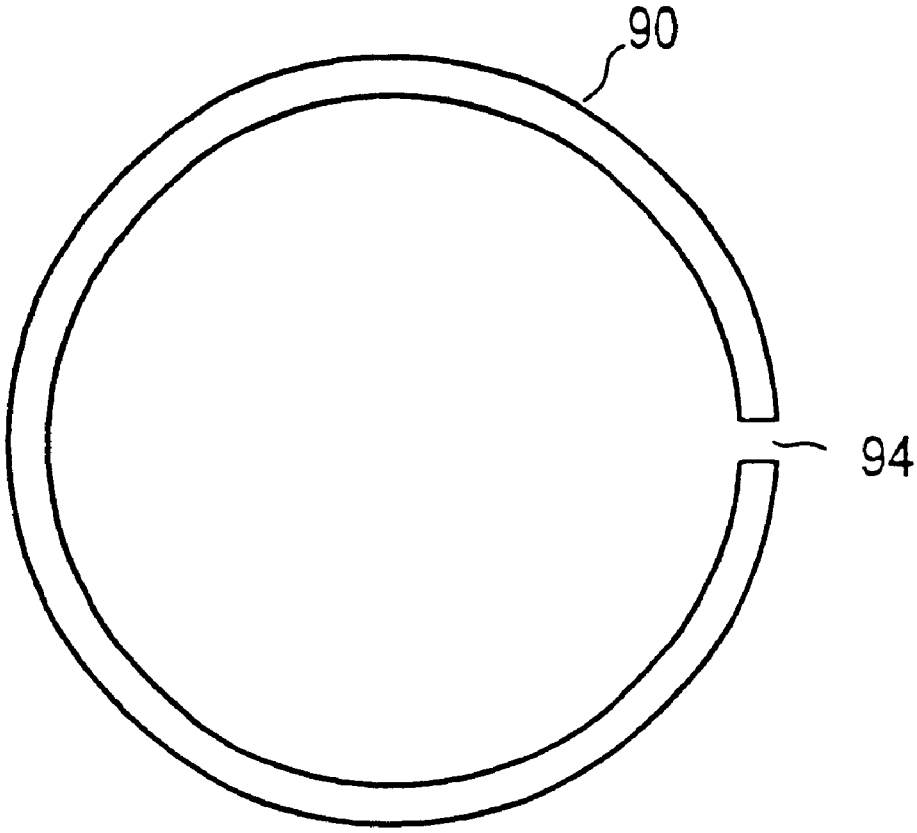
FIG. 11B is a plan view of the split sealing ring of FIG. 9.

It is possible to enhance the sealing performance of the modified tip of FIG. 9 by adding a split sealing ring around the reduced diameter portion of the muzzle tip such as shown in FIGS. 11A and B. The split sealing ring 90 is shown separately 90 and installed 91 on the reduced diameter portion 92 of the muzzle tip 93. The split sealing ring 94 is typically metal and has a tapered surface to allow the ring to ride up the tapered surface 95 on the muzzle tip 93 without yielding and breaking. The pressure in the hole bottom drives the sealing ring 91 into the gap between the sealing band 96 and the sidewall of the drill hole (not shown here, see FIG. 9). This will reduce the cross-sectional area of the gap and will substantially restrict the leakage mass flow rate.

Gas Generator Device with Stepped Drill Hole

Figure 12:
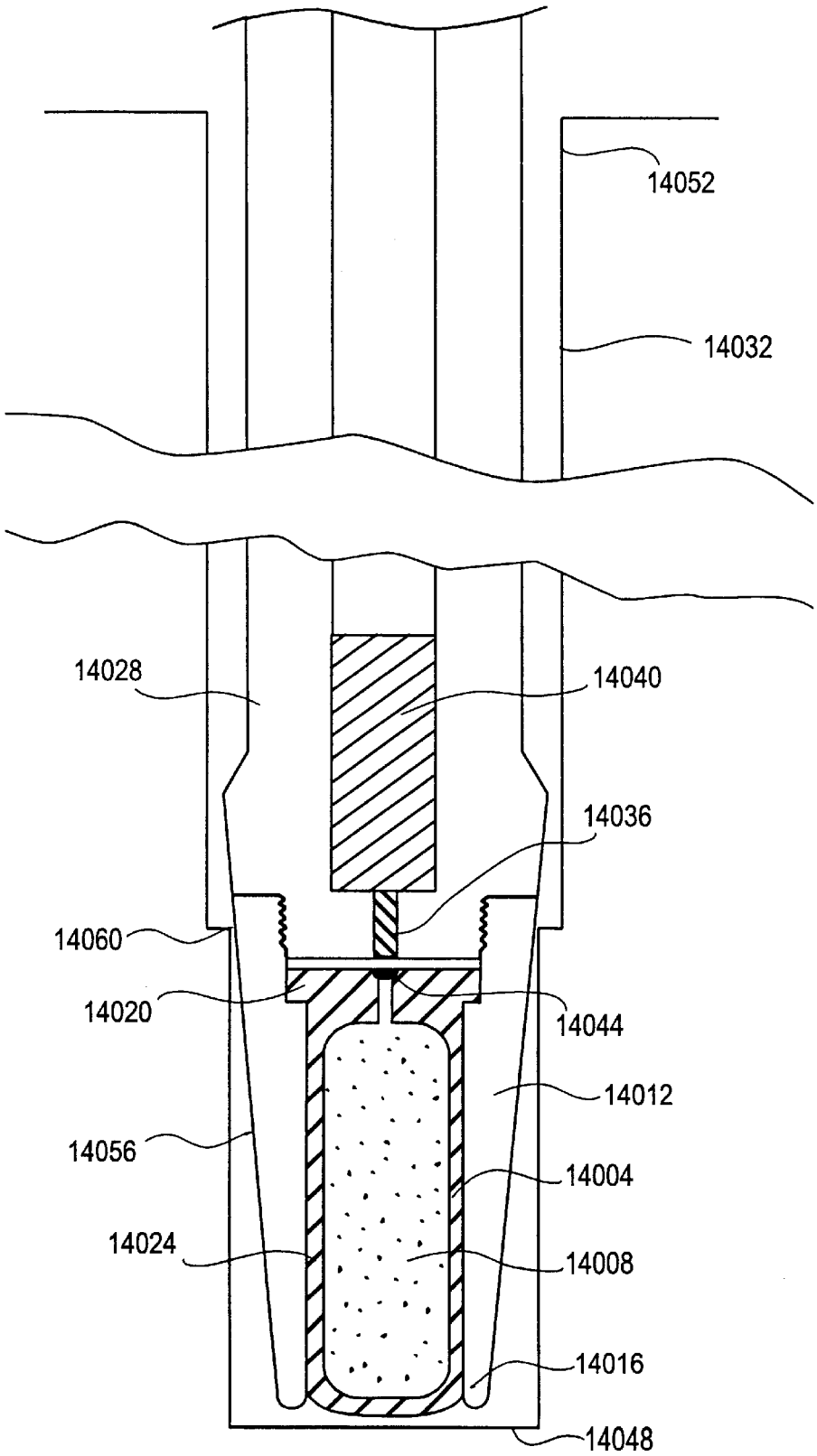
FIG. 12 is a cross sectional side view of a gas generator according to a fourth embodiment.

Another embodiment of the gas generator device of the present invention is shown in FIG. 12. It includes a cartridge 14004 containing a propellant charge 14008 which is hand-inserted into a cartridge housing 14012. The cartridge 14004 may be contained completely inside the cartridge housing 14012 or the distal end of the cartridge 14004 may protrude a small distance beyond the muzzle end 14016 of the cartridge housing 14012 (typically about one third or less of the overall cartridge length protrudes beyond the muzzle end 14016 of the cartridge housing 14012). The cartridge 14004 may be made with a metallic base 14020 attached to a plastic cartridge body 14024. Alternately, the cartridge 14004 may be formed from only one material such as a plastic, compressed paper, or any other suitable material including combustible material used for consumable ammunition.

When the cartridge 14004 has been inserted, the cartridge housing 14012 is then attached to the end of a long stemming bar 14028 by means of a full thread, an interrupted thread, a bayonet type lug, or another suitable attachment mechanism. The stemming bar 14028, which is usually attached to an undercarrier by means of an extension cylinder, is inserted into a drill hole 14032 such that the cartridge housing 14012 comes to rest at or near the bottom of the hole. It can be appreciated that the stemming bar can be mounted to any suitable undercarriage, that may or may not include a drill for performing the drilling function.

When the device is fully inserted, the propellant 14008 in the cartridge 14004 is initiated and the propellant 14008 is burned to completion generating a controlled high pressure in the bottom portion of the hole. The propellant 14008 may be initiated by a mechanical firing pin 14036, which is itself actuated by a firing pin assembly 14040, striking a percussion primer 14044 inserted in the cartridge base 14020. Alternately, an electric primer may be used and initiated by a current pulse transmitted through an electrical contact with a wire pair running down the stemming bar. The initiator can utilize any other initiation method, including inductive coupling.

Currently, the drill hole 14032 is formed by a reamer/pilot bit combination such that the distal portion 14048 of the drill hole 14032 is a smaller diameter than the proximal portion 14052 of the drill hole 14032. The outside of the cartridge housing 14012 has a slight taper 14056 (smaller diameter towards the distal end) so that the insertion will be stopped when the outside of the cartridge housing 14012 comes to rest on the step or ridge 14060 formed between the distal portion 14048 and the proximal portion 14052 of the drill hole 14032. The taper 14056 is preferably in the range of 0.5 to 3 degrees and most preferably in the range of 0.5 to 1.5 degrees.

Figure 13:
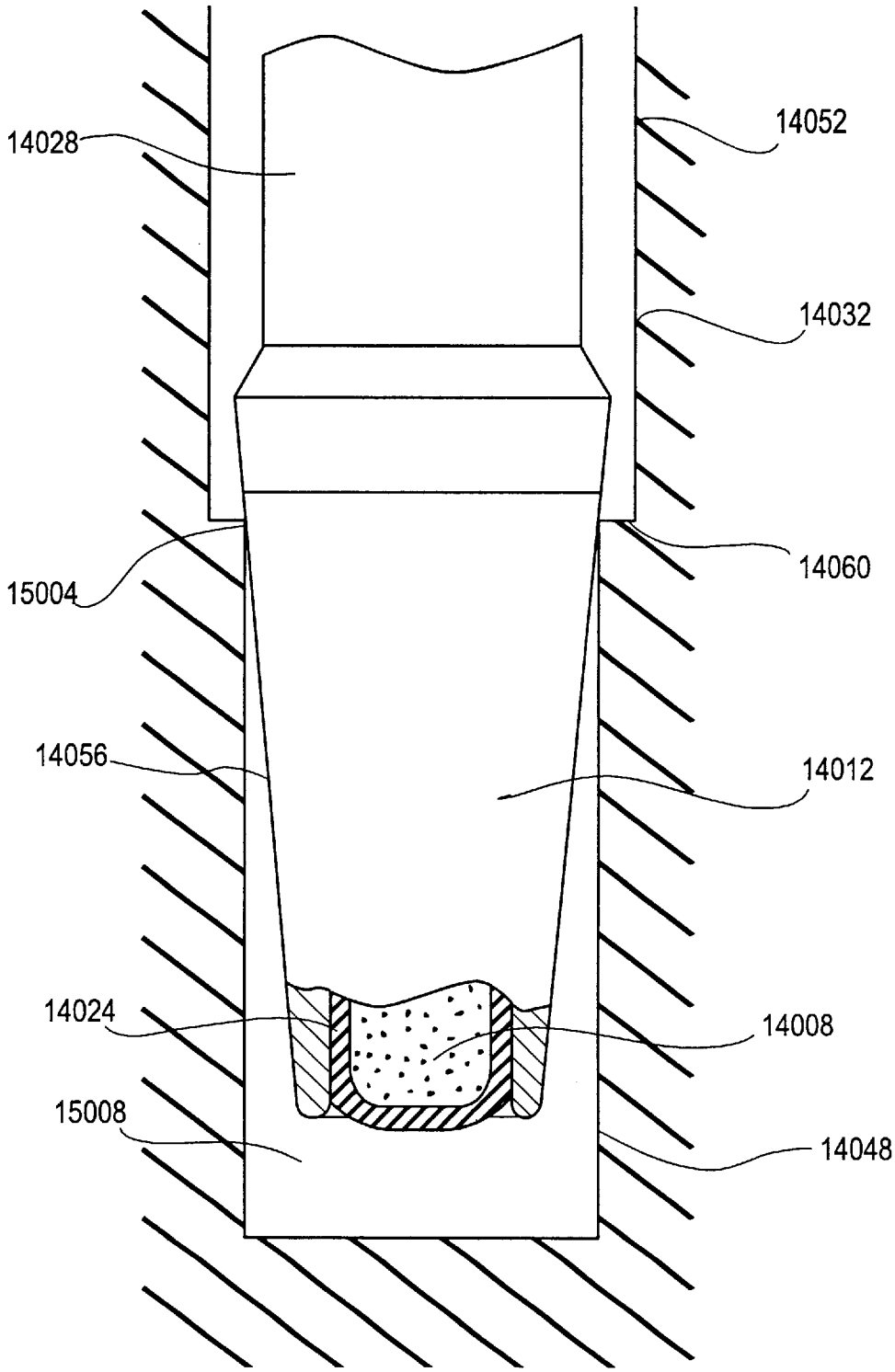
FIG. 13 is a partially cutaway side view of the gas generator of FIG. 12.

As illustrated in FIG. 13, the ridge 14060 of the stepped drill hole 14032 and the taper 14056 of the cartridge housing 14012 form a seal 15004 restricting the flow of pressurized gas in the hole bottom 15008 during the rock-breaking process. The partial cut-away at the distal end of the cartridge housing 14012 illustrates that the cartridge body 14024 and the propellant 14008 are positioned within the cartridge housing 14012.

Figure 14:
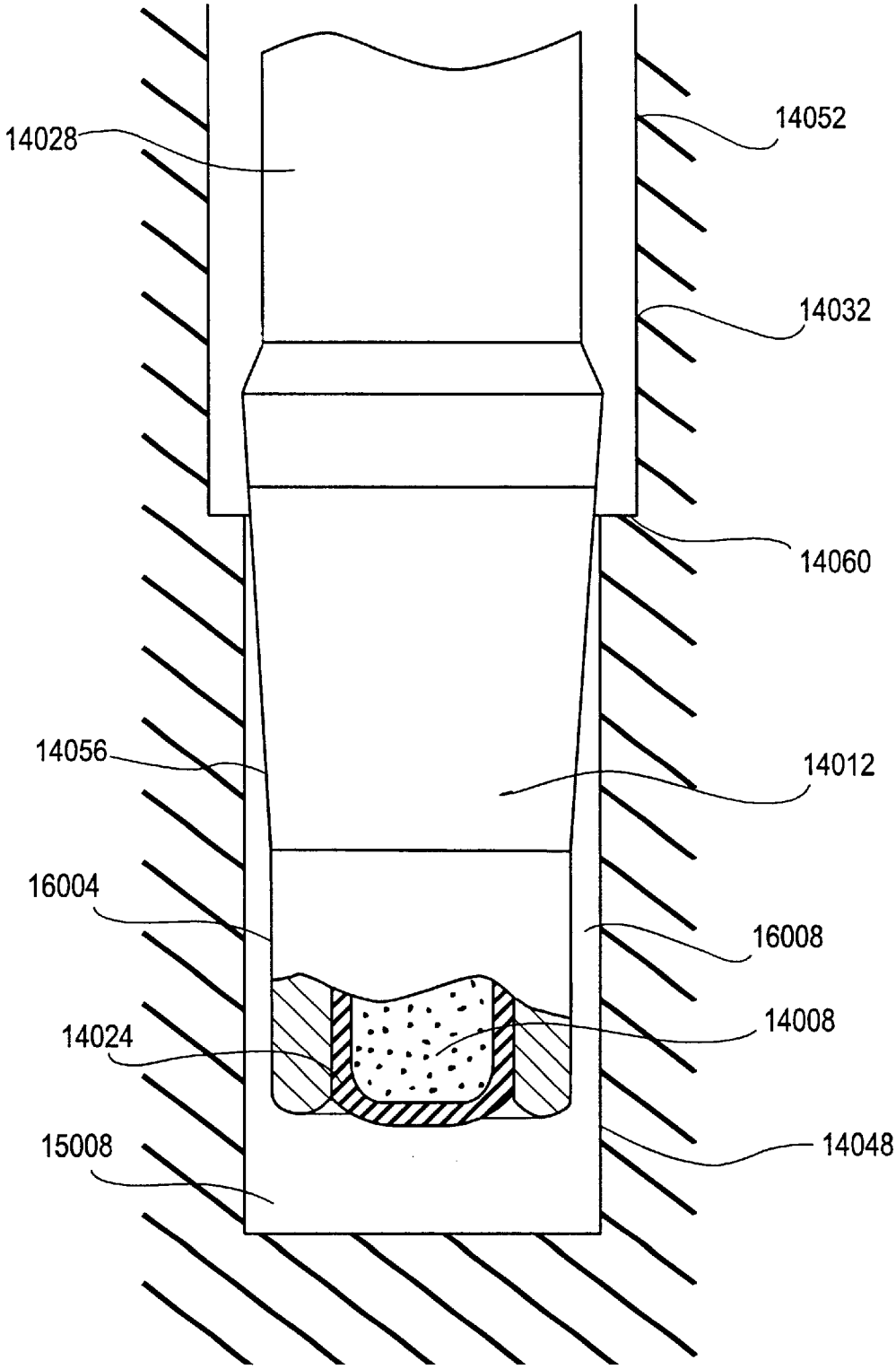
FIG. 14 is a partially cutaway side view of a gas generator according to a fifth embodiment.

Alternate sealing techniques are also possible. For example, as illustrated in FIG. 14, the cartridge housing 14012 may have a straight, constant diameter portion 16004 at its tip that is a reasonably tight fit in the distal portion 14048 of the drill hole 14032. This sealing method provides a gap 16008 that remains roughly constant, even as the device recoils away from the hole bottom 15008 after firing.

The diameter of the distal portion 14048 of the drill hole 14032 is preferably in the range of 30 to 150 mm and most preferably in the range of 50 to 120 mm. The amount of propellant 14008 is preferably in the range of 100 to 750 grams and most preferably in the range of 200 to 450 grams. The length (L) of the pilot hole (distal portion 14048 of the drill hole 14032), expressed in terms of bottom hole diameters (D), is preferably in the L/D range of 0.5 to 6 and most preferably in the L/D range of 1 to 3. The total volume available to the high pressure propellant gas products is such that the average density of the gas is preferably in the range of 100 to 750 $kg/m^3$ and most preferably in the range of 200 to 500 $kg/m^3$.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A small charge blasting system for breaking hard materials, comprising:

a chamber for receiving an energetic substance; and a barrel in communication with the chamber for extending into a hole in the material and releasing a pressurized working fluid generated by the energetic substance into the hole to initiate a fracture in the material, wherein the barrel has a bore having a first cross-sectional area normal to the bore's central axis at an interior portion of the bore and a second cross-sectional area normal to the bore's central axis at or near a downhole end portion of the bore, wherein the interior and downhole end portions are located at a distance from the discharge opening of the barrel and from the chamber, and wherein the first cross-sectional area is less than the second cross-sectional area to provide a relief volume at or near the downhole end portion of the bore for expansion of the pressurized working fluid.

2. The small charge blasting system of claim 1, wherein the bore is tapered outwardly between the bore sections having the first and second cross-sectional areas.

3. The small charge blasting system of claim 1, wherein the relief volume ranges from about 25% to about 125% of the reference volume.

4. The small charge blasting system of claim 1, wherein the downhole end of the wall of the barrel is rounded.

5. The small charge blasting system of claim 1, wherein the downhole end of the barrel contacts the bottom of the hole prior to release of the pressurized working fluid into the hole.

6. The small charge blasting system of claim 1, wherein the outer wall of the downhole end portion of the barrel has a smaller diameter than an uphole section of the barrel to provide a gap between the outer wall and the wall of the hole to permit the wall of the hole to be pressurized by the pressurized working fluid.

7. The small charge blasting system of claim 1, wherein the bore engages an end cap prior to release of the pressurized working fluid into the hole to inhibit the passage of extraneous fluids in the hole into the bore.

8. The small charge blasting system of claim 1, wherein the thickness of an interior portion of the barrel wall at the downhole end of the barrel is less than the thickness of the barrel wall at the end portion of the barrel to permit the interior portion of the barrel wall to flex outwardly in response to pressure exerted on the wall of the bore by the pressurized working fluid and thereby inhibit the escape of pressurized working fluid from the bottom of the hole.

9. The small charge blasting system of claim 8, wherein the thickness of the interior portion of the barrel wall is less than the thickness of the barrel wall on either side of the interior portion.

10. The small charge blasting system of claim 1, wherein an inwardly projecting lip is located at the downhole end of the barrel.

11. The small charge blasting system of claim 1, further comprising:

a ring that is received by at least a portion of the barrel exterior to seal the pressurized working fluid in the hole.

12. A small charge blasting system for breaking hard materials, comprising:

a chamber for receiving an energetic substance;

a barrel having a bore in communication with the chamber for extending into a hole in the material and releasing a pressurized working fluid into the hole to initiate a fracture in the material; and an end cap on a downhole end of the bore at a distance from the chamber and the energetic substance to substantially seal the bore from extraneous fluids in the bottom of the hole whereby the end cap is dislodged or ruptured by the pressurized working fluid.

13. The small charge blasting system of claim 12, wherein the bore has a first cross-sectional area normal to the bore's central axis at an interior portion of the bore and a second cross-sectional area normal to the bore's central axis at or near a downhole end portion of the bore and wherein the first cross-sectional area is less than the second cross-sectional area to provide a relief volume in the bore for expansion of the pressurized working fluid.

14. The small charge blasting system of claim 12, wherein the bore is tapered outwardly near the downhole end portion of the bore.

15. The small charge blasting system of claim 12, wherein the end cap is located between the downhole end of the chamber and the downhole end of the bore.

16. The small charge blasting system of claim 12, wherein the end cap has a strength low enough to rupture at a predetermined pressure exerted on the end cap by the pressurized working fluid.

17. The small charge blasting system of claim 12, wherein the downhole end of the barrel exterior is stepped or tapered inwardly to permit the working fluid to pressurize a sidewall of the hole.

18. A small charge blasting system for breaking hard materials, comprising:

a breech for receiving a cartridge;

a barrel in communication with the breech for extending into a hole in the material and releasing a pressurized working fluid into the hole to initiate a fracture in the material, wherein the barrel has an outer surface and a portion of the outer surface has a diameter at or near a downhole end of the barrel that is less than a diameter of a portion of the outer surface located in the bottom portion of the hole nearer the hole opening to provide a gap between the outer surface and sidewall of the hole and wherein the step is located at a distance of no more than about 150% of the hole diameter from the downhole end of the barrel to pressurize the hole bottom and sidewall of the hole.

19. The system of claim 18, further comprising an end cap on the downhole end of the barrel to substantially seal the bore from substances in the bottom of the hole.

20. The system of claim 18, wherein the downhole end of the barrel contacts the bottom of the hole.

21. The system of claim 18, wherein the downhole end of the bore has a diameter that is more than a diameter of a proximal portion of the bore to provide a relief volume for the pressurized working fluid.

22. A small charge blasting system for breaking rock and other materials, comprising:

means for generating a working fluid; and means for transporting the working fluid into a hole in a material to be broken, the transporting means extending into the hole, the transporting means having a distal end and a proximal end, the distal end being at or near the hole bottom and the transporting means being in communication with the generating means, wherein the diameter of the transporting means at or near the proximal end is less than the diameter of the transporting means at or near the distal end to provide a relief volume located in the transporting means for expansion of the working fluid.

23. The small charge blasting system of claim 22, wherein the transporting means has a diameter at or near the proximal end that is no more than about 60% of the diameter of the hole and the transporting means has a diameter at or near the distal end that is no more than about 80% of the hole diameter.

24. The small charge blasting method of claim 22, wherein the pressurized working fluid flows around the end of the transporting means to pressurize a sidewall of the hole.

25. The small charge blasting method of claim 22, wherein an interior portion of the wall of the transporting means flexes outwardly relative to the adjacent wall portions of the transporting means to inhibit the escape of the pressurized working fluid from the bottom of the hole.

26. A small charge blasting system for breaking rock and other materials, comprising:

means for generating a pressurized working fluid;

means for transporting the pressurized working fluid away from the generating means and into a hole in a material to be broken; and cap means on the transporting means, the cap means inhibiting the passage of material in a bottom of the hole and into the transporting means, wherein the pressurized working fluid applies a pressure against the cap means and wherein the cap means is configured such that at least one of the following conditions occurs: (i) dislodgement of the cap means from a surface of the transporting means and (ii) rupturing of the cap means such that in either condition the pressurized working fluid is released into the hole.

27. The small charge blasting system of claim 26, wherein the cap means is removable from the transporting means.

28. The small charge blasting system of claim 26, wherein the transporting means has a larger interior diameter at a downhole end of the transporting means than the diameter of an interior portion of the transporting means to provide a relief volume for the pressurized working fluid.

29. The small charge blasting system of claim 26, wherein the transporting means contains a relief volume between the cap means and the generating means.

* * * * *